US007618920B2

(12) United States Patent
Hada et al.

(10) Patent No.: US 7,618,920 B2
(45) Date of Patent: Nov. 17, 2009

(54) THERMAL RECORDING SHEET AND THERMAL RECORDING SHEET PACK

(75) Inventors: Yumi Hada, Amagasaki (JP); Hiroyuki Kido, Amagasaki (JP); Masaharu Nojima, Amagasaki (JP)

(73) Assignee: OJI Paper Co., Ltd., Tokyo (JP)

( * ) Notice: Subject to any disclaimer, the term of this patent is extended or adjusted under 35 U.S.C. 154(b) by 7 days.

(21) Appl. No.: 10/576,355

(22) PCT Filed: Oct. 15, 2004

(86) PCT No.: PCT/JP2004/015233

§ 371 (c)(1),
(2), (4) Date: May 1, 2007

(87) PCT Pub. No.: WO2005/037567

PCT Pub. Date: Apr. 28, 2005

(65) Prior Publication Data

US 2007/0203023 A1 Aug. 30, 2007

(30) Foreign Application Priority Data

Oct. 15, 2003 (JP) ..... 2003-354882
Jan. 15, 2004 (JP) ..... 2004-007928

(51) Int. Cl.
*B41M 5/30* (2006.01)
*B41M 5/41* (2006.01)

(52) U.S. Cl. ..... 503/200; 503/226

(58) Field of Classification Search ..... None
See application file for complete search history.

(56) References Cited

U.S. PATENT DOCUMENTS

| | | | | |
|---|---|---|---|---|
| 6,106,910 | A * | 8/2000 | Tan et al. | 428/29 |
| 6,972,781 | B2 * | 12/2005 | Tytgat | 347/171 |
| 2003/0036478 | A1 | 2/2003 | Seki et al. | |

FOREIGN PATENT DOCUMENTS

| | | | |
|---|---|---|---|
| JP | 64-9120 | Y1 | 1/1989 |
| JP | 2-84382 | A | 3/1990 |
| JP | 06-227053 | | 8/1994 |
| JP | 6-227053 | A | 8/1994 |
| JP | 7-276683 | A | 10/1995 |
| JP | 2000-94792 | A | 4/2000 |
| JP | 2000-128365 | A | 5/2000 |
| JP | 2002-59653 | | 2/2002 |
| JP | 2002-331752 | A | 11/2002 |
| JP | 2003-295402 | A | 10/2003 |
| JP | 2004-34703 | A | 2/2004 |

* cited by examiner

*Primary Examiner*—Bruce H Hess
(74) *Attorney, Agent, or Firm*—Kirschstein, et al.

(57) ABSTRACT

A thermal recording sheet comprising, on one surface of square, transparent film, a thermal recording layer containing leuco dye and a coloration agent and a protection layer mainly containing water-based resin, wherein corner parts (1*a*, 1*b*, 1*c*, 1*d*) including at least one marked corner part (1*a*) are provided at its four corners. The corner parts (1*a*, 1*b*, 1*c*, 1*d*) respectively have end edges each with radius of curvature of at least 5 mm, and the end edge of the marked corner part (1*a*) is provided substantially with a maximum radius of curvature or a minimum radius of curvature.

9 Claims, 6 Drawing Sheets

THERMAL RECORDING SHEET AND THERMAL RECORDING SHEET PACK

TECHNICAL FIELD

The present invention relates to a thermal recording sheet employing the color development reaction of leuco dye and a coloring agent, and a pack containing a bundle of such thermal recording sheets (wrapping for a bundle of thermal recording sheets).

BACKGROUND ART

Thermal recording sheets employing the color development reaction of leuco dye and a coloring agent are relatively inexpensive, and in addition, recording devices for such thermal recording sheets are compact and easy to maintain, and therefore, are widely used as recording mediums for facsimiles and recording mediums for printers for word processors and computers.

In addition, thermal recording sheets having excellent transparency and quality of recorded images have recently been used as recording mediums which substitute silver films for recording medical images, such as medical radiographs.

A notch is provided in a certain place in conventional silver films for recording medical images, in order to facilitate accurate differentiation of front and rear faces, as well as left and right, of the film when handling the film in a darkroom (see Patent Document 1).

Likewise, in the case of a thermal recording sheet, the higher the transparency thereof is, the more difficult it is to differentiate between the recording surface and the rear surface. In the case where an image is recorded on a thermal recording sheet, in general, an image recording device such as a printer is used, and the thermal recording sheet is loaded in a sheet storing portion of the image recording device. However, the loading operation of thermal recording sheets in the image recording device is troublesome, and mistakes easily occurs in the loading operation of sheets in the case that it is difficult to differentiate between the recording surface and the rear surface of the thermal recording sheets.

In addition, in the case where an image is recorded on a thermal recording sheet employing an image recording device, it is necessary to accurately set a large number of thermal recording sheets in the sheet storing portion of the image recording device, and therefore, a bundle of thermal recording sheets which are integrated with wrapping are usually loaded in the sheet storing portion as a thermal recording sheet pack.

In addition, conventional thermal recording sheet packs are intended to have such a configuration as to be usable with as small floor space as possible (see Patent Document 2).

In recent years, image recording devices where thermal recording sheet packs can be placed vertically as well as horizontally (also referred to as being placed flatly) have been developed taking saving of space into consideration. In the case that a thermal recording sheet pack is used when placed vertically, however, it is necessary to set a bundle of thermal recording sheets standing in the sheet storing portion of the image recording device, and therefore, a problem arises with conventional thermal recording sheet packs, such that it is difficult to set the pack accurately.

Patent Document 1: Japanese Utility Model Publication No. 2549363

Patent Document 2: Japanese Laid-Open Patent Publication H10-157704

DISCLOSURE OF THE INVENTION

Problem to be Solved by the Invention

An object of the present invention is to provide a thermal recording sheet for recording a medical image, the thermal recording sheet being able to facilitate differentiation between front and rear faces thereof and prevent miss loading in an image recording device such as a printer or a schaukasten.

In addition, another object of the present invention is to provide a thermal recording sheet pack able to prevent thermal recording sheets from being bent or scratched, and facilitate loading thereof in the sheet storing portion of either type, a horizontally placing type or a vertically placing type image recording device, and prevent occurrence of scratches at the time of transportation or at the time of loading in an image recording device.

Means for Solving the Problems

In order to achieve the object, the first invention provides a thermal recording sheet comprising a square and transparent film, the film being provided with a thermal recording layer containing leuco dye and a coloring agent and a protective layer mainly containing water-based resin on one surface thereof, and having four corner portions, including at least one marked corner portion, at the four corners thereof, the corner portions respectively having an edge with a curvature radius of no less than 5 mm, the marked corner portion having substantially a maximum curvature radius or a minimum curvature radius.

In the configuration of the first invention, preferably, a pair of the marked corner portions are arranged oppositely to each other on one diagonal line of the thermal recording sheet, or preferably, all of the corner portions, except the marked corner portion having the edge with the maximum curvature radius (Rmax), have an edge with approximately the same curvature radius (R), and the ratio (Rmax/R) of the maximum curvature radius (Rmax) to the curvature radius (R) is no less than 2.

In addition, preferably, the edge with the maximum curvature radius consists of an arc of less than a ¼ circle and each of the remaining edges consists of an arc of a ¼ circle, or preferably, each of the edges of the corner portions substantially smoothly connects to linear edges of the main body portion of the thermal recording sheet.

Preferably, the thermal recording sheet further comprises a note indication for differentiating front and back faces of the thermal recording sheet according to a position of the marked corner portion.

In order to achieve the object, the second invention provides a thermal recording sheet pack, comprising: a bundle of thermal recording sheets consisting of a stack of thermal recording sheets according to the first invention; a protective cover sheet covering substantially the whole of the lower surface of the bundle of thermal recording sheets, the protective cover sheet comprising: a protective cover main body having approximately the same form as each of the thermal recording sheets of the bundle of thermal recording sheets and contacting with the lower surface of the bundle of thermal recording sheets; a rear contact portion provided in standing position at one edge of the protective cover main body so as to contact with a rear end face of the bundle of thermal recording sheets in a sheet feed direction; and a pair of side contact portions provided in standing position at a pair of edges perpendicular to the one edge of the protective cover main body so as to contact with both sides of the bundle of thermal recording sheets, the thermal recording sheet pack further comprising: a thin membrane (thin film) band for holding the bundle of thermal recording sheets between the side contact portions of the protective cover sheet, the thin membrane band crossing over between the pair of side contact portions when the bundle of thermal recording sheets are placed on the protective cover main body, and contacting with at least outer side surfaces of the pair of side contact portions, and being pressed against a portion of the upper surface of the bundle of thermal recording sheets so as to hold the bundle; and an annular thin membrane (thin film) for holding the bundle of thermal recording sheets in a sheet feed direction, the annular thin membrane being placed so as to surround the outside of the protective cover sheet and the bundle of thermal recording sheets in the sheet feed direction when the bundle of thermal recording sheets are placed on the protective cover main body, and contacting with at least the outer sides of the rear contact portion, and being pressed against front end face of the bundle of thermal recording sheets located oppositely to the rear contact portion, as well as at least a portion on the upper surface of the bundle of thermal recording sheets.

In the configuration of the second invention, the height of a portion of the side contact portions of the protective cover sheet, the portion being covered with at least the thin membrane band, as well as the height of a portion of the rear contact portion of the protective cover sheet, the portion being covered with at least the annular thin membrane, are respectively smaller than the thickness of the bundle of thermal recording sheets.

Furthermore, preferably, two ends of the thin membrane band are respectively joined to the corresponding side contact portions, the annular thin membrane is placed on the upper side of the thin membrane band, and a portion of the annular thin membrane is formed to be easily cut.

In addition, preferably, the protective cover sheet is formed of a plastic resin and the thin membrane band and the annular thin membrane are formed of a film, respectively.

EFFECTS OF THE INVENTION

A thermal recording sheet of the present invention facilitates differentiation between front and rear faces thereof and prevent miss loading of the thermal recording sheet in a printer or a schaukasten is prevented.

A packing of the present invention prevents occurrence of scratches on thermal recording sheets at the time of transportation thereof and at the time of loading of the thermal recording sheets in an image recording device.

DESCRIPTION OF REFERENCE NUMERALS

1*a*: a marked corner portion

1*b*, 1*c*, 1*d*: corner portions

2: a protective cover sheet

Figure 1:
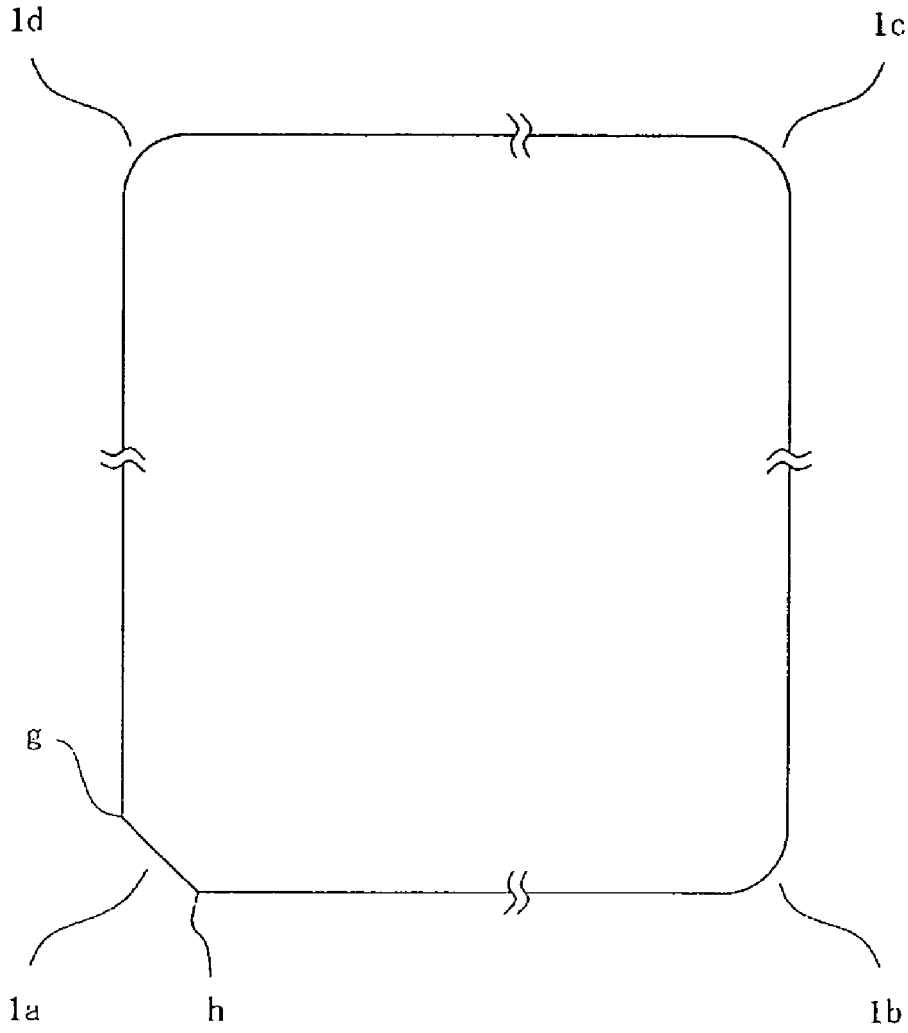
FIG. 1 is a plan view showing a thermal recording sheet according to one embodiment of the present invention.

3: a thin membrane band for holding a bundle of thermal recording sheets between side contact portions of a protective cover sheet

4: an annular thin membrane for holding a bundle of thermal sheet recording sheets in a sheet feed direction

6: a bundle of thermal recording sheets

7: a thermal recording sheet pack

BEST MODE FOR CARRYING OUT THE INVENTION

A thermal recording sheet according to the present invention comprises a square and transparent film which is provided with a thermal recording layer containing leuco dye and a coloring agent and a protective layer mainly containing water-based resin on one surface thereof. The thermal recording sheet has four corner portions, including at least one marked corner portion, at the four corners thereof. The corner portions respectively have an edge with a curvature radius of no less than 5 mm and the marked corner portion has substantially a maximum curvature radius or a minimum curvature radius.

Preferably, a pair of the marked corner portions are arranged oppositely to each other on a diagonal line of the thermal recording sheet. In this case, a slight difference in the size of the edges of the pair of marked corner portions is allowed. In any case, a marked corner portion can be easily recognized by the eye or confirmed by the touch as a mark which indicates the front and rear faces of the thermal recording sheet.

In the case that the curvature radius of each of the edges of the four corner portions is the same, the thermal recording sheet has exactly the same shape even when placed upside down, and the front and rear faces of the sheet cannot be distinguished. Among the four corner portions, at least one corner portion has an edge with the curvature radius different from the curvature radius of the edges of the remaining corner portions, so that the thermal recording sheet has a different shape when placed upside down and thereby, the front and rear faces of the thermal recording sheet can be distinguished.

When the curvature radius of the edge of the corner portions becomes smaller than 5 mm, the corner portions of the thermal recording sheet are essentially sharp, so that the following problems may arise; the thermal recording sheet is not fed smoothly, and the corners are caught by a casing or the like when the thermal recording sheet is supplied to an image recording device such as a printer, or the thermal recording sheet is caught by clothing or the like at the time of handling, and thus, the thermal recording sheet is dropped and the recording surface thereof is damaged. In addition, there is also a risk that the corner portions may contact with and scratch the surface of another thermal recording sheet.

Reducing the curvature radius of the edge of the marked corner portion leads to sharpening of the corner, as described above, and therefore, it is preferable to make the curvature radius great. When the curvature radius is increased in such a manner that the corner portion consists of a ¼ circle, however, an area for printing is reduced. Accordingly, it is more practical, in order to secure as wide an area for printing as possible, to restrict the amount to be cut in all of the corner portions to a small amount. Under such a restriction, it is preferable to cut the corner portions into an arc form smaller than a ¼ circle.

In the case of a thermal recording sheet in rectangular form of 17 inches×14 inches, which is practical, concretely, it is preferable to form the edges of three corner portions of the thermal recording sheet into a ¼ circle arc having a curvature radius of approximately 10 mm, the edge of the marked corner portion into an arc of less than a ¼ circle, and form the corner portions by cutting the same linear length from the apex of the corner at each of the corners (this is described below).

Here, the maximum curvature radius of the edge of the marked corner portion may be infinite, that is to say, the edge of the marked corner portion may be a linear edge formed by cutting the corner of the sheet crosswise. In such a case, it is preferable to form the marked corner portion in such a manner that the edge of the marked corner portion can be smoothly connected to a linear edge of the main body portion of the thermal recording sheet so as to form a smooth curve as a whole. Concretely, a punching process may be carried out using an indenting mold with cut lines having smooth curves.

In addition, it is more user friendly to indicate in some form which corner portion is selected as the marked corner portion, and therefore, a separate sheet of paper with a note written on it, such as "the surface of the thermal recording sheet faces upward when the corner portion having a large curvature is placed in the lower left," may be inserted for each bundle where a large number of thermal recording sheets are layered. In addition, it is possible to print the note in small type or to thermally print it on each thermal recording sheet, if necessary.

As the transparent film, a polyethylene terephthalate film, a polystyrene film, a polypropylene film, a polycarbonate film or the like which is either not expanded or expanded biaxially can be cited. As for the thickness of this film, approximately 40 μm to 300 μm provides excellent spreading properties, and thus, is preferable. In particular, the effects of the present invention are enhanced for transparent films having a thickness of approximately 100 μm to 300 μm, specifically, transparent polyethylene terephthalate films having a thickness of approximately 150 μm to 250 μm.

The transparent film may be colored blue with a haze value of no greater than 10%, in order to make the thermal recording sheet more appropriate for Schaukasten. Here, as the haze value of the thermal recording sheet, approximately 10% to 50% is preferable. Here, a corona discharging process may be carried out, or an anchor coating layer may be formed on the front and rear surfaces of the transparent film.

As for the thermal recording system using a combination of an electron donor compound and an electron acceptor compound which are contained in the thermal recording layer, a combination of leuco dye and a coloring agent, a combination of diazonium salt and a coupler, a combination of an organic silver salt and a reducing agent, a combination of a transition element, such as iron, cobalt or copper, and a chelate compound, a combination of an aromatic isocyanate compound and an imino compound and the like can be cited as examples, but the combination of leuco dye and a coloring agent provides excellent coloring concentration, and therefore, is preferably used. In the following, a thermal recording sheet made of a combination of leuco dye and a coloring agent is described in detail.

As the leuco dye and the coloring agent, various types of well-known leuco dyes and coloring agents can be used. 3-[2,2-bis(1-ethyl-2-methylindole-3-yl)vinyl]-3-(4-diethylaminophenyl)phthalide, 3,3-bis(p-dimethylaminophenyl)-6-dimethylaminophthalide, 3-(4-diethylamino-2-methylphenyl)-3-(4-dimethylaminophenyl)-6-dimethylaminophthalide, 3-cyclohexylamino-6-chlorofluoran, 3-diethylamino-6-methyl-7-chlorofluoran, 3-diethylamino-6,7-dimethylfluoran, 3-diethyl amino-7-chlorofluoran, 3-(N-ethyl-N-isoamyl)amino-6-methyl-7-anilino fluoran, 3-di(n-butyl)amino-6-methyl-7-anilinofluoran, 3-di(n-pentyl)amino-6-methyl-7-anilinofluoran, 3-(N-ethyl-p-toluidino)-6-methyl-7-anilinofluoran, 3-di(n-butyl) amino-6-chloro-7-anilinofluoran, 3-pyrrolidino-6-methyl-7-anilinofluoran, 3-piperidino-6-methyl-7-anilinofluoran, 3,3-bis[1-(4-methoxyphenyl)-1-(4-dimethyl aminophenyl) ethylene-2-yl]-4,5,6,7-tetrachlorophthalide, 3-p-(p-dimethyl aminoanilino)anilino-6-methyl-7-chlorofluoran, 3-p-(p-chloroanilino) anilino-6-methyl-7-chlorofluoran, 3-[1,1-bis (1-ethyl-2-methylindole-3-yl)]-3-p-diethylaminophenylphthalide, 3,3'-bis(1-n-butyl-2-methylindole-3-yl) phthalide, and 3,6-bis(dimethylamino) fluoren-9-spiro-3'-(6'-dimethylamino)phthalide can be cited as concrete examples of the leuco dye.

The combination is, of course, not limited to these, and it is also possible to use two or more types together. In addition, the used amount of leuco dye is not limited, because it is different, depending on the used coloring agent, but approximately 5 mass % to 35 mass % of the total solid amount of the thermal recording layer is preferable.

As the coloring agent, 4,4'-isopropylidenediphenol, 4,4'-cyclohexylidenediphenol, 1,1-bis(4-hydroxyphenyl)-ethane, 1,1-bis(4-hydroxyphenyl)-1-phenyl ethane, 4,4'-dihydroxydiphenylsulfone, 2,4'-dihydroxydiphenylsulphone, 4-hydroxy-4'-isopropoxydiphenylsulfone, 3,3'-diallyl-4,4'-dihydroxydiphenylsulfone, 2,2'-bis[4-(4-hydroxyphenyl) phenoxy]diethyl ether, 4,4'-bis[(4-methyl-3-phenoxycarbonyl amiophenyl)ureide]diphenylsulfone, N-p-toluenesulfonyl-N'-3-(p-toluenesulfonyloxy)phenylurea, 3,3'-bis(p-toluenesulfonylaminocarbonylamino)diphenylsulfone, 4-hydroxy benzyl benzoate, N,N'-di-m-chlorophenylthiourea, N-p-tolylsulfonyl-N'-phenylurea, 4,4'-bis(p-tolylsulfonylaminocarbonylamino)diphenylmethane, 4-[2-(p-methoxyphenoxy)ethyloxy]zinc salicylate, 4-{3-(p-tolylsulfonyl)propyloxy}zinc salicylate and 5-[p-(2-p-methoxyphenoxyethoxy)cumyl]zinc salicylate can be cited as examples.

An appropriate ratio of use of the leuco dye to a coloring agent is selected in accordance with the type of used leuco dye and coloring agent, and is not particularly limited, but in general, 1 mass part to 10 mass parts, preferably, approximately 2 mass parts to 6 mass parts of a coloring agent, is used per 1 mass part of leuco dye.

Here, leuco dye may be used in the form of microcapsules contained in a resin membrane, or in the form of compound grains contained in a resin, and thereby, a thermal recording sheet having a small haze value may be gained, which is preferable. Approximately 0.5 μm to 3.0 μm is preferable as the volume average diameter of the microcapsules or compound grains.

It is possible for the thermal recording layer to contain a preservation improving agent for enhancing the preservation and safety of the recording portion and a sensitizing agent for enhancing the recording sensitivity. As concrete examples of this preservation improving agent, hindered phenol compounds, such as 2,2'-ethylidene bis(4,6-di-tert-butylphenol), 4,4'-thiobis(2-methyl-6-tert-butylphenol), 1,3,5-tris-(4-tert-butyl-3-hydroxy 2,6-dimethylbenzyl)isocyanurate, 1,1,3-tris (2-methyl-4-hydroxy-5-tert-butylphenyl)butane, 1,1,3-tris (2-methyl-4-hydroxy-5-cyclohexylphenyl)butane, and 2,2-bis(4-hydroxy-3,5-dimethylphenyl)propane, 1,4-diglycidyloxybenzene, 4,4'-diglycidyloxydiphenylsulfone, 4-benzyloxy-4'-(2-methylglycidyloxy)diphenyl sulfone, diglycidyl terephthalate, epoxy compounds, such as cresol novolac type epoxy resins, phenol novolac type epoxy resins and bisphenol A type epoxy resins, N,N'-di-2-naphthyl-p-phenylenediamine and bis(4-ethyleneiminocarbonylaminophenyl) methane can be cited as examples.

As concrete examples of the sensitizing agent, amide stearate, methylene bisamide stearate, dibenzyl terephthalate, p-benzyloxy benzyl benzoate, 2-naphtyl benzyl ether, m-terphenyl, p-benzyl biphenyl, p-tolylbiphenyl ether, di(p-methoxyphenoxyethyl)ether, 1,2-di(3-methylphenoxy)ethane, 1,2-di(4-methylphenoxy)ethane, 1,2-di(4-methoxyphenoxy) ethane, 1,2-di(4-chlorophenoxy)ethane, 1,2-diphenoxy ethane, 1-(4-methoxyphenoxy)-2-(3-methylphenoxy) ethane, p-methylthiophenylbenzylether, 1,4-di(phenylthio) butane, p-acetotoluidide, p-acetophenetidide, N-acetoacetyl-p-toluidine, di(β-biphenylethoxy)benzene, di-p-chlorobenzyl oxalate, di-p-methylbenzyl oxalate, and dibenzyl oxalate can be cited as examples.

Though the used amount of the preservation improving agent and sensitizing agent is not particularly limited, it is generally approximately 1 mass part to 400 mass parts for 100 mass parts of the coloring agent.

The thermal recording layer is formed using water as a medium for dispersion, and in such a manner that leuco dye and a coloring agent, and if necessary, a sensitizing agent, a preservation improving agent and the like are crushed into a fine powder having an average grain diameter of no greater than 3 μm, preferably no greater than 2 μm, together or separately using a mixer or a grinder, such as a ball mill, an attriter or a sand mill, and after that, at least an adhesive is added and a liquid for application as a thermal recording layer is prepared and then applied to the front surface of a transparent membrane and dried, so that the amount of application after drying becomes approximately 3 $g/m^2$ to 30 $g/m^2$.

As the adhesive in the liquid for application as a thermal recording layer; water soluble adhesives, such as starches, hydroxyethyl cellulose, methyl cellulose, carboxymethyl cellulose, casein, polyvinyl alcohol, carboxy denatured polyvinyl alcohol, diacetone acrylamide denatured polyvinyl alcohol, acetoacetyl denatured polyvinyl alcohol, silicon denatured polyvinyl alcohol, a copolymer salt of diisobutylene/maleic anhydride, a monovalent salt of a copolymer of styrene/maleic anhydride, a monovalent salt of a copolymer of ethylene/acrylic acid, and a monovalent salt of a copolymer of styrene/acrylic acid, and water dispersed adhesives, such as vinyl acetate based latex, styrene-butadiene based latex, acryl based latex and urethane based latex can be cited as examples.

The used amount of adhesive is approximately 8 mass % to 40 mass % or the total solid content of the thermal recording layer. Furthermore, the thermal recording layer may contain a variety of additives. As these additives, pigments such as amorphous silica of which the average grain diameter of primary grains is approximately 0.01 μm to 2.0 μm, calcium carbonate, zinc oxide, aluminum oxide, titanium dioxide, aluminum hydroxide, barium sulfate, talc, kaolin, clay, sintered kaolin and urea/formalin resin fillers, surfactants, such as sodium dioctyl sulfosuccinate, sodium dodecyl benzene sulfosuccinate and sodium lauryl alcohol sulfate, lubricants, such as zinc stearate, calcium stearate and calcium oleate, waxes, such as polyethylene wax, carnauba wax and paraffin, antifoaming agents, thickening agents, pH adjusting agents, ultraviolet ray absorbing agents, optical stabilizing agents, cross liking agents, fluorescent dyes and coloring dyes can be cited as examples. The additives are, of course, not limited to these, and two or more types from among the additives can be used together.

A protective layer having a water based resin having membrane forming properties as a main component is provided on the thermal recording layer in order to enhance recording scanning properties, resistance to friction and resistance to chemicals, and thereby, such effects are gained that the transparency of the thermal recording sheet is further enhanced.

As for the water based resin in this protective layer, the adhesive in the thermal recording layer, for example, is used. Furthermore, pigments, cross linking agents, waxes and lubricants contained in the thermal recording layer can also be used in the protective layer.

The protective layer is generally formed using water as a medium, and a water based resin solution is mixed and stirred with pigments, cross linking agents, waxes, lubricants and the like, if necessary, and a liquid for application as a protective layer is prepared, and then, applied to the thermal recording layer and dried, so that the amount after drying becomes approximately 0.5 $g/m^2$ to 10 $g/m^2$.

As for the method for applying a liquid for application as each layer to a transparent membrane, as described above, any well-known application method, such as a slot dye method, a slide bead method, a curtain method, an air knife method, a blade method, a gravure method, a roll coater method, a spray method, a dipping method, a bar method and an extrusion method, may be used.

A smoothening process is carried out using a well-known smoothing method, such as super calendaring, soft calendaring or the like after the formation of each layer, and thus, effects of enhancing the coloring sensitivity of the layer are provided. The process may be carried out by making the thermal recording surface make contact with either a metal roll or an elastic roll of a calendar.

Embodiment 1

Though the present invention is described in further detail using the embodiments described below, the present invention is not limited to these. Here, "parts" and "%" indicate "mass parts" and "mass %," respectively, unless otherwise stated.

Preparation of a Compound Grain Dispersion Liquid Containing Leuco Dye (Solution A)

12 parts of 3-di(n-butyl)amino-6-methyl-7-anilinofluoran, 5 parts of 3-diethylamino-6,8-dimethylfluoran and 3 parts of 3,3'-bis(4-diethylamino-2-ethoxyphenyl)-4-azaphthalide as leuco dye, and 5 parts of 2-hydroxy-4-octyl oxybenzophenone as an ultraviolet ray absorbing agent, were dissolved in a mixed solvent made of 11 parts of dicyclohexylmethane-4,4'-diisocyanate (made by Sumitomo Bayer Urethane Co., Ltd., Desmodur W) and 11 parts of m-tetramethylxylylene diisocyanate (made by Mitsui Takeda Chemicals Inc., TMXDI) through heating (150° C.), and this solution was gradually added to 100 parts of a solution including 8.8 parts of polyvinyl alcohol (made by Kuraray Co., Ltd., Poval PVA-217EE) and 0.5 parts of an ethylene oxide additive (made by Nissin Chemical Industry Co., Ltd., Olfine E1010) of acetylene glycol as a surfactant, and emulsified and dispersed through stirring at a rotational speed of 10000 rpm using a homogenizer. 30 parts of water and a solution in which 2.5 parts of a multiple value amine compound (made by Shell International Petroleum Co., Ltd., Epikure T) was dissolved in 22.5 parts of water were added to the emulsified dispersion liquid, which was then homogenized. This emulsified dispersion liquid was heated to a temperature of 75° C., and a polymerization reaction was made to occur for 7 hours, and thus, a compound grain dispersion liquid having black coloring properties having an average grain diameter of 0.8 μm (measured in accordance with a laser beam diffraction method) was prepared. In addition, the concentration of the solid content in the compound grain dispersion liquid having black coloring properties was adjusted to 20% with water.

Preparation of Solution B

A composition made of 25 parts of 4,4-dihydroxy diphenyl sulfone, 15 parts of 3,3'-diaryl-4,4'-dihydroxy diphenyl sulfone, 40 parts of a solution of 25% of polyvinyl alcohol (made by Kuraray Co., Ltd., Kuraray Poval PVA-203), 5 parts of an emulsion of 2% of a natural oil and it based antifoaming agent, 10 parts of a solution of 5% of sodium dioctyl sulfosuccinate and 50 parts of water were crushed using a lateral type sand mill (made by Aimex Co., Ltd., Ultra Visco Mill UVX-2) until the average grain diameter was 0.3 μm, and thus, a solution B was gained.

Preparation of Solution for Application as Thermal Recording Layer

A composition made of 150 parts of solution A, 115 parts of solution B, 20 parts of a solution of 7% of polyvinyl alcohol [made by Kuraray Co., Ltd., Kuraray Poval® PVA-235], 30 parts of a styrene-butadiene based latex [made by Nippon A&L Inc, solid content: 48%, Smartex® PA9281], 50 parts of ionomer type urethane based resin latex (made by Dainippon Ink and Chemicals, Incorporated, Hydran® AP-30F, solid concentration: 20%), 8 parts of a solution of 5% of dihydrazide adipate and 30 parts of water were stirred, and a liquid for application as a thermal recording layer was gained.

Preparation of Liquid for Application as Protective Layer

A composition made of 100 parts of ionomer type urethane based resin latex (made by Dainippon Ink and Chemicals, Incorporated, Hydran® AP-30F, solid concentration: 20%), 500 parts of a solution of 8% of acetoacetyl denatured polyvinyl alcohol (made by Nippon Synthetic Chemical Industry Co., Ltd., Gohsefimer® OKS-3431, degree of polymerization: approximately 2300, degree of saponification: approximately 98 mol %), 5 parts of a solution of 25% of polyamide amine/epichlorohydrin, 50 parts of a slurry of 60% of kaoline (made by Engelhard Corporation, UW-90) having an average grain diameter of 0.8 μm, 26 parts of amide stearate (made by Chukyo Yushi Co., Ltd, Himicron L271, solid concentration: 25%), 4 parts of potassium stearyl phosphate (made by Matsumoto Yushi-Seiyaku Co., Ltd., Upole 1800, solid concentration: 35%), 15 parts of a solution of 10% of added perfluoro alkyl ethylene oxide (Seimi Chemical Co., Ltd., Surflon® S-145) and 300 parts of water were mixed and stirred so as to gain a liquid for application as a protective layer.

Fabrication of Thermal Recording Sheet

A liquid for application as a thermal recording layer and a liquid for application as a protective layer were sequentially applied to one surface of a blue transparent polyethylene terephthalate membrane (trade name: Melinex® 914, made by Teijin DuPont Membranes Japan Limited) having a thickness of 175 μm and dried, so that the amount after drying became 25 g/m$^2$ and 3 g/m$^2$, respectively, and thus, a thermal recording layer and a protective layer were provided, and a thermal recording sheet was gained.

Corner Cutting Process

Figure 2:
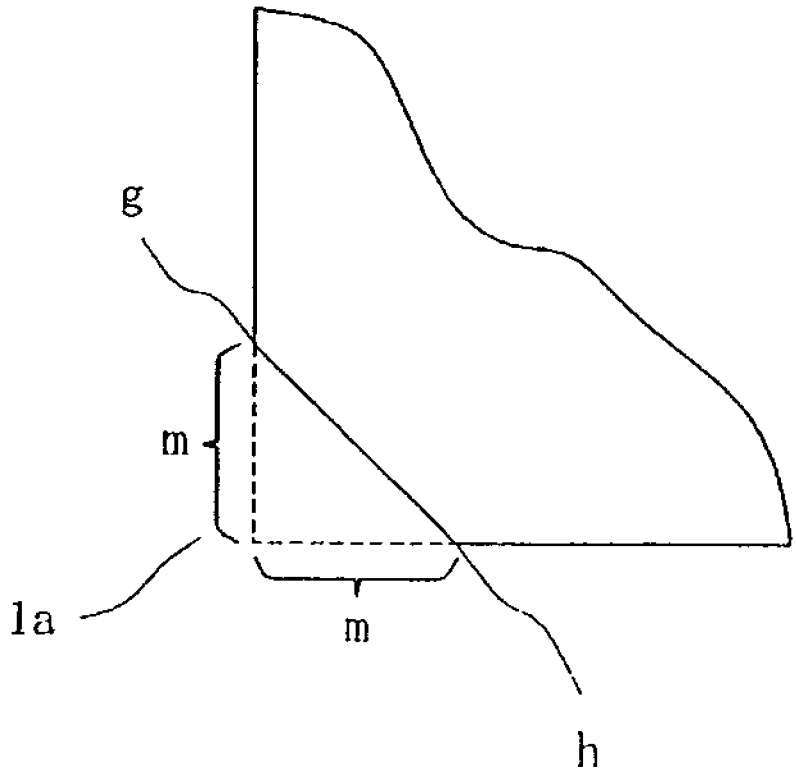
FIG. 2 is an enlarged view showing a corner portion of FIG. 1.

A thermal recording sheet which was cut into a rectangle of 17 inches×14 inches was prepared as described above, and three out of the four corners of the sheet were cut into ¼ circles with a curvature radius of 10 mm. The remaining corner of the sheet was a marked corner portion, and was cut so as to have a curvature radius of 30 mm, where the curve was drawn starting from the same portion of the other three corners. That is to say, the marked corner portion having the greatest curvature radius (curvature radius: 30 mm) had an edge of an arc of less than a ¼ circle, whereas the other three corner portions, excluding the marked corner portion, had an edge of an arc of a ¼ circle. This state is shown in FIG. 1. It can be seen in FIG. 1 that marked corner portion 1*a* is closer to a line in comparison with the other corner portions 1*b*, 1*c* and 1*d*. FIG. 2 is an enlarged view showing corner portion 1*a* shown in FIG. 1. In FIG. 2, the length, indicated by m, is the length that corresponds to the line portion in the cut portion of the corner portion, and in the case where this length is the same in all of the four corners, the sheet is visually symmetrical, which is preferable. In order to make this length the same, the marked corner portion is cut "so that the curve is drawn starting from the portion as the other three corners" when the marked corner portion is formed as described above.

Here, when the curvature radius of the edge of this marked corner portion is the greatest curvature radius (Rmax), the edges of the other three corner portions have an arc of a ¼ circle having the same curvature radius (R), and the conditions are satisfied, $$R\max/R=2^{1/2}/(2\times\sin(\theta/2)) \quad (1)$$

is gained, where θ is the center angle of the arc of the edge of the marked corner portion.

In formula (I), θ becomes approximately 52° when Rmax/R is 2, and it can be seen that the edge of the marked corner portion approximately becomes an arc of a ⅐ circle of which the circumference angle is much smaller than the arc of a ¼ circle (the center angle of the arc is 90°).

These corner portions can be formed through simultaneous processing of a large amount of sheets, approximately 100 sheets at a time, by using an indenting mold, and therefore, the corner portions can be created very efficiently.

Comparative Example 1

In the process for forming the corner portions of Embodiment 1, the edges of the four corner portions are all formed as an arc of a ¼ circle having a curvature radius of 10 mm.

[Evaluation of Thermal Recording Sheet]

The gained thermal recording sheets were respectively evaluated in the following manner.

(Determination of Front and Rear)

When the front and the rear of thermal recording sheets with a marked corner portion according to the present invention arc lined up, the corners having a curvature radius of 30 mm are lined up, and thereby, the front and rear are automatically in the same direction. In addition, in the case where the front and rear of a thermal recording sheet are facing the wrong way, the corner portion having a curvature radius of 10 mm protrudes, and therefore, it can be immediately be found out which thermal recording sheet is placed wrongly. Meanwhile, in the case where the four corners have the same form, as in Comparative Example 1, it cannot be immediately found whether front and rear are wrongly mixed, and it becomes necessary to check the sheets one by one.

[Further Improvement]

In the Embodiment 1, connection portions g and h between the edge of marked corner portion 1*a* and the linear ends of the main body portion of the thermal recording sheet form so-called dull angles, but still have corners. Accordingly, it is more preferable to form corner portions in smooth curve form, unlike connection portions g and h with such corners, in order to lower the risk of the corners being caught and the occurrence of scratching. Concretely, an indented mold having such smooth cut lines may be used for the punching process.

[Other Method for Recognizing Marked Corner Portion]

In addition, though it is possible to form a corner portion in such a manner that the corner portion has such features as to have a cloud shape, a C form or the like, in accordance with the idea that a corner portion having a different form is provided as a marked corner portion as described above, this would cause problems, such that processing is troublesome and scratches may be caused on the surface of other sheets when finishing of the cut portions is not properly carried out, and therefore, it is more preferable to adopt the manner of cutting of corners according to which the radii of curvature described above are gained.

In addition, it is also possible to color a marked corner portion by means of inkjet printing or the like. However, it would become necessary to process the sheets one by one, which is disadvantageous in comparison with the sheets with corner portions of which a large amount can be cut at one time. Though it is also possible to color only one edge of the corner portion of overlapping sheets at one time in order to process a large amount of sheets, this would be disadvantageous from the point of view of clarity. In addition, there is a risk that color may easily come off from the edge through friction or the like, and thus, this can be expected to be disadvantageous.

Next, a thermal recording sheet pack of the present invention is described in reference to the attached drawings. The thermal recording sheet pack is provided with a bundle of thermal recording sheets made of a layered body of thermal recording sheets, each of which is the same as that described above, as well as a protective cover sheet which essentially covers the entirety of the lower surface of the bundle of thermal recording sheets.

The bundle of thermal recording sheets is made of a layered body of, for example, approximately 250 thermal recording sheets, each of which is the same as that described above. In an image recording device, a side in the longitudinal direction of this bundle of thermal recording sheets is generally set in the sheet feed direction.

Figure 3:
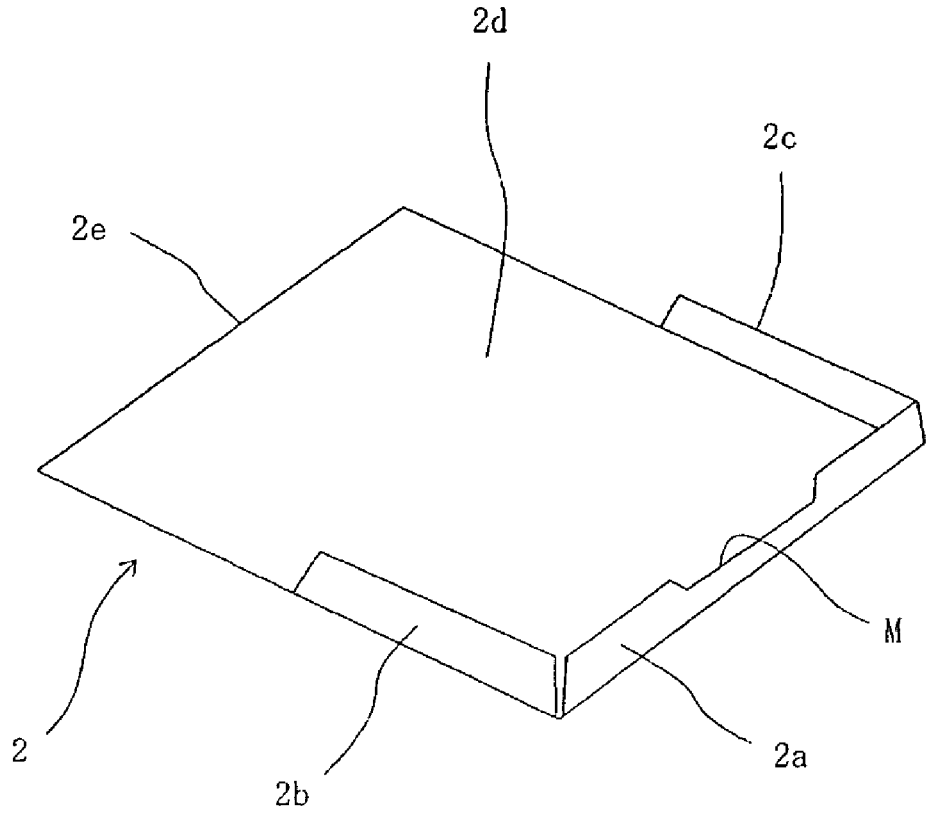
FIG. 3 is a perspective view showing a protective cover sheet constituting a main component of a thermal recording sheet pack of the present invention.

FIG. 3 is a perspective view showing a protective cover sheet constituting a main component of a thermal recording sheet pack. As shown in FIG. 3, a protective cover sheet 2 has approximately the same form as that of the thermal recording sheets of a bundle of thermal recording sheets. The protective cover sheet 2 comprises a protective cover main body 2*d* contacting with the lower surface of the bundle of thermal recording sheets, a rear contact portion 2*a* provided in standing position at one edge of the protective cover main body 2*d* so as to contact with the end face of the bundle of thermal recording sheets in a sheet feed direction, and a pair of side contact portions 2*b* and 2*c* provided in standing position at a pair of edges perpendicular to the one edge of the protective cover main body 2*d* so as to contact with both sides of the bundle of thermal recording sheets.

The protective cover sheet 2 can be formed by bending a sheet member after it has been cut into a predetermined form, so that edge portions forming the rear contact portion 2*a* and the side contact portions 2*b* and 2*c* stand upright to the region forming the protective cover main body 2*d*. As the material for forming protective cover sheet 2, a material which can maintain certain strength, including plastic resins, such as polypropylene and PET (polyethylene terephthalate), paper and synthesized paper, can be used. A plastic material of which the color is made white by kneading in titanium oxide or a colored plastic material are also appropriate for use. Approximately 1 mm is sufficient for the thickness of the protective cover sheet of which the dimensions are approximately the same as those described below.

A bundle of thermal recording sheets are placed on the protective cover sheet 2, and thereafter, integrated together with the protective cover sheet 2 into a thermal recording sheet pack.

Figure 4:
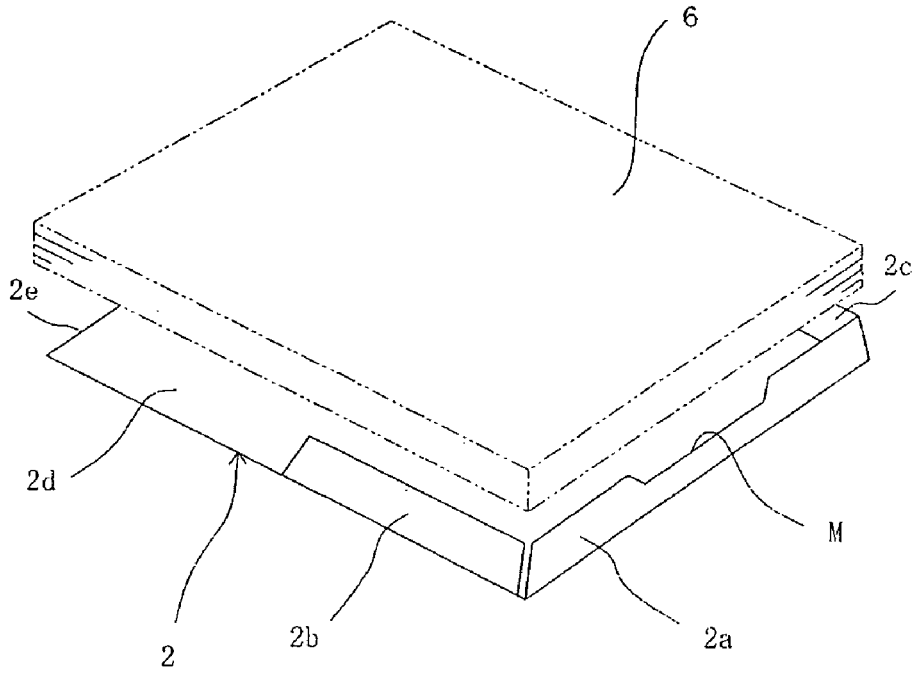
FIG. 4 is an exploded perspective view showing a bundle of thermal recording sheets placed on a protective cover sheet.

FIG. 4 is an exploded perspective view showing a bundle of thermal recording sheets placed on the protective cover sheet. Referring to FIG. 4, the protective cover main body 2*d* has a form which is approximately the same as the lower surface of bundle of thermal recording sheets 6, that is to say, the thermal recording sheet of the bundle of thermal recording sheets. Preferably, the height of the rear contact portion 2*a* and the side contact portions 2*b* and 2*c* are respectively slightly smaller than the thickness of bundle of thermal recording sheets 6. Usually, the thickness of the bundle of thermal recording sheets 6 does not exceed approximately several tens of mm, and therefore, the height is set approximately several mm smaller than this thickness. In addition, preferably, the bundle of thermal recording sheets 6 is placed on the protective cover sheet 2 in such a manner that the thermal recording surface makes contact with protective cover main body 2*d*, from the point of view of protection of the thermal recording surfaces.

All of the portions 2*a*, 2*b* and 2*c* of the protective cover sheet 2 just make contact with the bundle of thermal recording sheets 6 when the bundle of thermal recording sheets 6 is placed on the protective cover main body 2*d*. That is to say, the thermal recording sheets are sequentially fed out in the direction opposite to the rear contact portion 2*a* when the thermal recording sheet pack is loaded in an image recording device.

Figure 5:
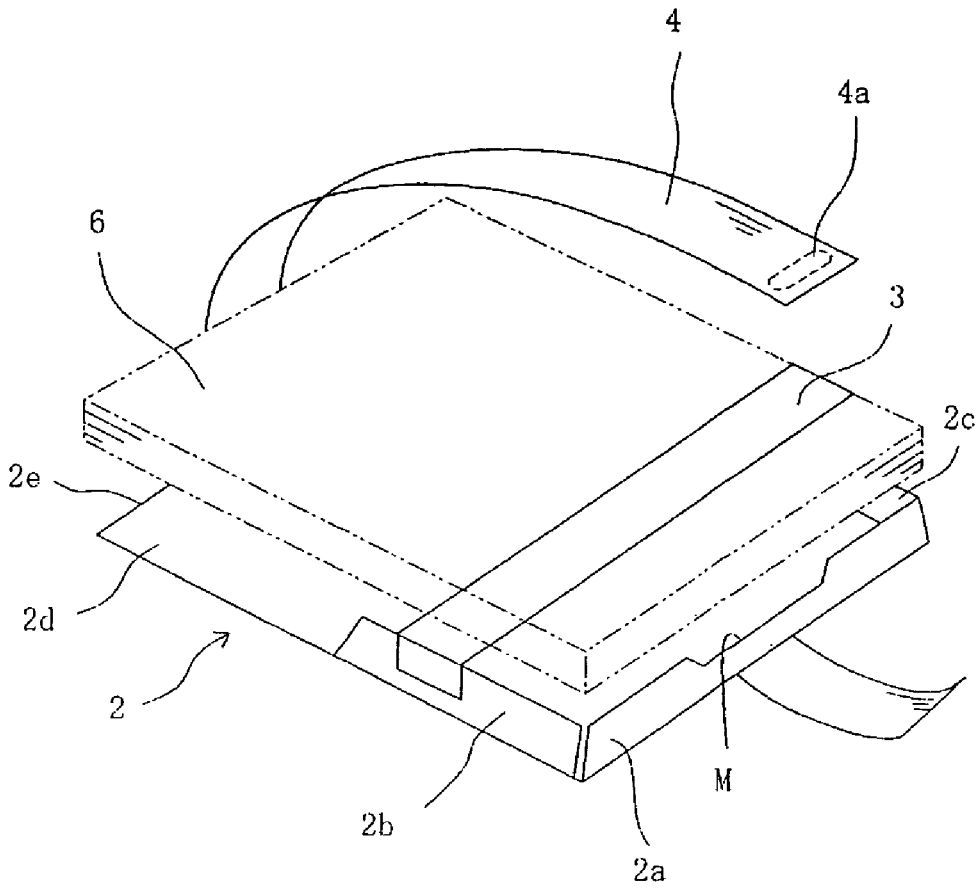
FIG. 5 is a perspective view showing a bundle of thermal recording sheets in process of integrating with a protective cover sheet.
Figure 6:
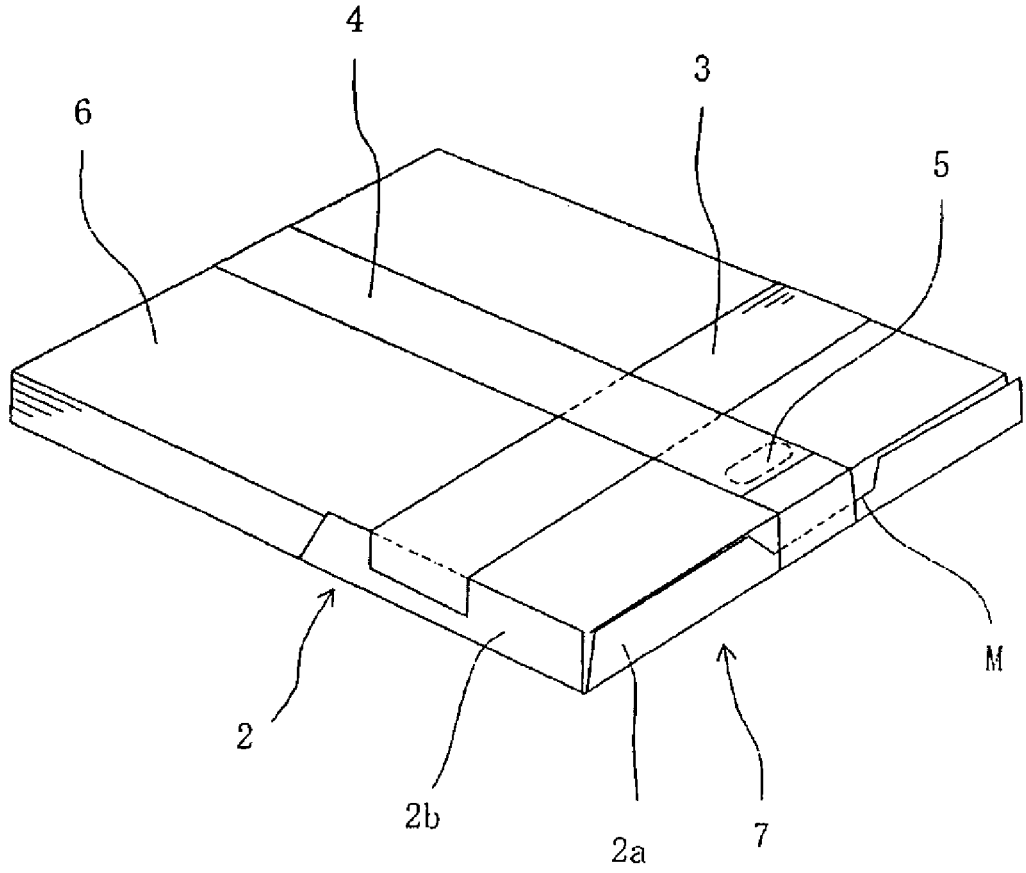
FIG. 6 is a perspective view showing a bundle of thermal recording sheets integrated with a protective cover sheet.

FIG. 5 is a perspective view showing a bundle of thermal recording sheets in process of integrating with a protective cover sheet and FIG. 6 is a perspective view showing a bundle of thermal recording sheets integrated with a protective cover sheet. Referring to FIGS. 5 and 6, the thermal recording sheet pack further comprises a thin membrane band 3 for holding the bundle of thermal recording sheets 6 between the side contact portions 2*b* and 2*c* of the protective cover sheet 2. The thin membrane band 6 crosses over between the pair of side contact portions 2*b*, 2*c* when the bundle of thermal recording sheets 6 are placed on the protective cover main body 2*d*, and contacts with the outer side surfaces of the pair of side contact portions 2*b*, 2*c* and are pressed against a portion of the upper surface of the bundle of thermal recording sheets 6 so as to hold the bundle 6 in which two ends of the thin membrane band are respectively joined to the side contact portions 2*b* and 2*c* of the protective cover sheet 2.

The thin membrane band 3 crosses over between portions 2*b* and 2*c*, and covers a portion of the upper surface of the bundle of thermal recording sheets 6. Here, when the height of the side contact portions 2*b* and 2*c* is slightly smaller than the thickness of the bundle of thermal recording sheets 6, thin membrane band 3 can be tensed with an appropriate tensile force, and thereby, the sheet surface of the bundle of thermal recording sheets 6 is pressed against the protective cover main body 2*d*, and at the same time, the pair of side contact portions 2*b* and 2*c* are pressed against the bundle 6, and therefore, the bundle 6 can be held in such a manner as not to collapse, particularly in a direction perpendicular to the sheet feed direction, that is to say, in a direction in which the pair of side contact portions 2*b* and 2*c* are aligned. Thin membrane band 3 is fixed by joining two ends thereof to the outside surface of the side contact portions 2*b* and 2*c* by means of an adhesive, a double sided adhesive tape or the like.

The thermal recording sheet pack further comprises an annular thin membrane 4 for holding the bundle of thermal recording sheets in the sheet feed direction. The annular thin membrane 4 is placed so as to surround the outside of the protective cover sheet 2 and the bundle of thermal recording sheets 6 in the sheet feed direction when the bundle of thermal recording sheets 6 is placed on the protective cover main body 2*d*, and contacts with at least the outer sides of the rear contact portion 2*a*, and is pressed in the sheet feed direction against front end of the bundle of thermal recording sheets 6 located oppositely to the rear contact portion 2*a*, an end 2*e* of the protective cover sheet 2 located oppositely to the rear contact portion 2*a* and at least a portion on the upper surface of the bundle of thermal recording sheets 6 so as to hold the bundle 6. The annular thin membrane 4 is formed in angular forms as shown in FIG. 5, when an adhesive is applied to one end thereof (see portion 4*a* in the figure), and the other end is made to overlap and adhere to this portion 4*a*.

Here, when the height of the rear contact portion 2*a* is slightly smaller than the thickness of bundle of thermal recording sheets 6, the sheet surface of the bundle 6 can be pressed against the protective cover main body 2*d*, and at the same time, the rear contact portion 2*a* can be pressed against the bundle 6 by tensing the annular thin membrane 4 with an appropriate tensile force, and therefore, the bundle of thermal recording sheets 6 can be held in such a manner as not to collapse, particularly in the sheet feed direction.

In particular, as can be seen from FIGS. 5 and 6, in the case of a configuration in which the center portion M of the rear contact portion 2*a* is lower, appropriate pressure for pressing the bundle of thermal recording sheets 6 against this portion is applied, and at the same time, the portion other than the center portion M is set so as to have a height smaller than the thickness of the bundle 6, and thereby, the rear contact portion 2*a* contacts with the bundle 6 more tightly, and thereby, the bundle 6 can be prevented from shifting in the sheet feed direction.

As described above, the bundle of thermal recording sheets 6 and the protective cover sheet 2 are integrated with the thin membrane band 3 and the annular thin membrane 4 into a thermal recording sheet pack 7. Preferably, the thermal recording sheet pack 7 is packed in a bag so in an approximately air tight manner, so that the contents of each pack are protected at the time of transportation and handling.

When the thermal recording sheet pack 7 is loaded in a recording device, only the annular thin membrane 4 is removed, so that the thermal recording sheets can be individually fed out after the completion of loading, which is preferable because the thermal recording sheets can be easily loaded with barely a risk that the thermal recording sheets will shift at the time of loading. A this time, it is preferable for the thin membrane 4 to be foxed in annular form, so that this thin membrane 4 can be easily removed without fail. In addition, preferably, the annular thin membrane 4 is placed on the upper side of thin membrane band 3, so that it is possible to remove only the annular thin membrane 4.

The thin membrane band 3 and the annular thin membrane 4 can be formed of a thin film, such as a thin synthetic resin film or a sheet of paper. It is more preferable for these to be formed of a resin membrane, rather than a sheet of paper, because it is better that no dust or particles are mixed into the system. This is the same for the material of the protective sheet. A polypropylene membrane or the like having a thickness of no greater than 100 μm is appropriate for use.

The thin membrane band 3, the annular thin membrane 4 and protective cover sheet 2 are wrapping materials for the thermal recording sheet pack of the present invention.

In addition, preferably, the two ends of thin membrane band 3 respectively are joined to the side contact portions 2*b* and 2*c* of protective cover sheet 2, the annular thin membrane 4 is placed on the upper side of thin membrane band 3, and a portion 5 which can be easily cut as described above is provided to a portion of the annular thin membrane 4 allows for easy removal of only annular thin membrane 4 when the thermal recording sheet pack is loaded in an image recording device. It is possible to form the portions 5 which can be easily cut into various structures, for example, a structure where a cut in broken line form is simply made in a membrane, a structure where a membrane in narrow string form for the wrapping of sweets is used, and a structure where two ends of a membrane are overlapped with each other and adhered to each other with a seal member having adhesive on the rear surface thereof.

The rear contact portion 2*a* and the side contact portions 2*b* and 2*c* may have any shape, as long as the shape allows these portions to their function properly. These portions make contact with the side portions of the bundle of thermal recording sheets 6 in order to function of supporting the bundle of thermal recording sheets, and therefore, it is preferable for them to have as large an area as possible. Accordingly, as shown in FIG. 3, the recess M having a depth of approximately several mm and of which the width is slightly greater than the width of the annular thin membrane 4 covering this portion, is formed in the vicinity of the center of the rear contact portion 2*a*, and thereby, the area of contact can be increased to the maximum, and the height of at least the portion of the rear contact portion 2*a* covered with the annular thin membrane 4 can be made smaller than the thickness of the bundle of thermal recording sheets 6. The recess may be provided to the side contact portions 2*b* and 2*c* in the same manner.

In addition, as can be seen from the figures, the side contact portions 2*b* and 2*c* do not cover the entire surface of the sides of the bundle of thermal recording sheets 6. This is because the absence of the side contact portions 2*b* and 2*c* in these portions is advantageous when the sheet feeding mechanism feeds thermal recording sheets one by one after the sheets are loaded in an image recording device, in terms of the mechanism of the device.

These portions which make contact with the bundle of thermal recording sheets can be appropriately modified in number or location, as well as in the configuration, in accordance with existing recording devices and the like.

Conventional thermal recording sheet packs are carried in a state of being packed in a bag where a moisture proof membrane formed of, for example, an aluminum sheet or an aluminum sheet laminated with propylene, is used, so that the entirety is sealed. They are usually taken out from this bag after being carried and directly before being loaded in an image recording device. Therefore, a problem arises with the surface for recording images, such that thermal recording sheets repeat microscopic movements on top of the protective cover sheet due to the vibration or impacts received while being carried, and thus, scratches and scratching occurs on the thermal recording surface. In the thermal recording sheet pack according to the present invention, portions which make contact with the bundle of thermal recording sheets are provided in three portions on the edges of the protective cover main body, and in addition, a thin membrane band and an annular thin membrane are used, and thereby, occurrence of scratches can be prevented.

The thermal recording sheet pack of the present invention is particularly appropriate for containing a layered body of thermal recording sheets for recording medical images. That is to say, depiction in particularly fine detail is required for images which are used in the medical field, and the ability to create high quality images having excellent vividness, sharpness and higher definition is required. Images of monochrome tone tend to be preferred, from the point of view of ease of diagnosis. Though in the case where there is a scratch or scratching on a membrane for recording medical images, there is a risk of misdiagnosis being made, the membranes used in the form of the thermal recording sheet pack of the present invention can prevent the occurrence of scratches and scratching without fail, and thus, misdiagnosis can be prevented.

INDUSTRIAL APPLICABILITY

The present invention can be applied to transparent thermal recording sheets which are used industrially or for other applications, in addition to recording mediums for recording medical images, the recording mediums employing a thermal recording sheet comprising, on one surface of square, transparent film, a thermal recording layer containing leuco dye and a coloration agent and a protection layer mainly containing water-based resin.

In addition, the thermal recording sheet pack according to the present invention can be applied as a pack for containing a bundle of sheets for use in a recording medium of which the recording surface should be sensitively protected, in addition to thermal recording sheets.

The invention claimed is:

1. A thermal recording sheet having a front thermal recording surface and a rear surface, comprising: a square and transparent film, said film being provided with a thermal recording layer containing leuco dye and a coloring agent and a protective layer mainly containing water-based resin on the front thermal recording surface, and having four corner portions, at the four corners of the sheet, the four corner portions consisting of one marked corner portion and three unmarked corner portions of the same shape, each corner portion having an edge with a curvature radius of no less than 5 mm, the curvature radius of the edge of said one marked corner portion being larger or smaller than the curvature radius of the edge of each of said three unmarked corner portions, whereby said front thermal recording surface is differentiated from said rear surface depending on the position of said one marked corner portion at the four corners of the sheet.

2. The thermal recording sheet according to claim 1, wherein the ratio (Rmax/R) of the maximum curvature radius (Rmax) of the edge of said one marked corner portion to said curvature radius (R) of the edge of each of said three unmarked corner portions is no less than 2.

3. The thermal recording sheet according to claim 1, wherein said edge of said one marked corner portion consists of an arc of less than a ¼ circle and wherein said edge of each of said three unmarked corner portions consists of an arc of a ¼ circle.

4. The thermal recording sheet according to claim 1, wherein each of the edges of said four corner portions substantially smoothly connects to linear edges of a main body portion of said thermal recording sheet.

5. The thermal recording sheet according to claim 1, further comprising a note indication for differentiating the front thermal recording surface and the rear surface of said thermal recording sheet according to a position of said one marked corner portion.

6. A thermal recording sheet pack, comprising:

a bundle of thermal recording sheets consisting of a stack of thermal recording sheets, each sheet having a front thermal recording surface and a rear surface, each sheet comprising a square and transparent film, said film being provided with a thermal recording layer containing leuco dye and a coloring agent and a protective layer mainly containing water-based resin on the front thermal recording surface, and having four corner portions at the four corners of the sheet, the four corner portions consisting of one marked corner portion and three unmarked corner portions of the same shape, each corner portion having an edge with a curvature radius of no less than 5 mm, the curvature radius of the edge of said one marked corner portion being larger or smaller than the curvature radius of the edge of each of said three unmarked corner portions, whereby said front thermal recording surface is differentiated from said rear surface depending on the position of said one marked corner portion at the four corners of the sheet;

a protective cover sheet covering substantially a whole of a lower surface of said bundle of thermal recording sheets, said protective cover sheet comprising:

a protective cover main body having approximately the same form as each of said thermal recording sheets of said bundle of thermal recording sheets and contacting with the lower surface of said bundle of thermal recording sheets;

a rear contact portion provided in standing position at one edge of said protective cover main body so as to contact with a rear end face of said bundle of thermal recording sheets in a sheet feed direction; and a pair of side contact portions provided in standing position at a pair of edges perpendicular to said one edge of said protective cover main body so as to contact with both sides of said bundle of thermal recording sheets, said thermal recording sheet pack further comprising:

a thin membrane band for holding said bundle of thermal recording sheets between said side contact portions of said protective cover sheet, said thin membrane band crossing over between said pair of side contact portions when said bundle of thermal recording sheets are placed on said protective cover main body, and contacting with at least outer side surfaces of said pair of side contact portions, and being pressed against a portion of an upper surface of said bundle of thermal recording sheets so as to hold said bundle; and an annular thin membrane for holding the bundle of thermal recording sheets in the sheet feed direction, said annular thin membrane being placed so as to surround the outside of said protective cover sheet and said bundle of thermal recording sheets in said sheet feed direction when said bundle of thermal recording sheets is placed on said protective cover main body, and contacting with at least the outer sides of said rear contact portion, and being pressed against a front end face of said bundle of thermal recording sheets located oppositely to said rear contact portion, as well as at least a portion on the upper surface of said bundle of thermal recording sheets.

7. The thermal recording sheet pack according to claim 6, wherein the height of a portion of said side contact portions of said protective cover sheet, said portion being covered with at least said thin membrane band, as well as the height of a portion of said rear contact portion of said protective cover sheet, said portion being covered with at least said annular thin membrane, are respectively smaller than the thickness of said bundle of thermal recording sheets.

8. The thermal recording sheet pack according to claim 6, wherein two ends of said thin membrane band are respectively joined to the corresponding side contact portions, wherein said annular thin membrane is placed on the upper side of said thin membrane band, and wherein a portion of said annular thin membrane is formed to be easily cut.

9. The thermal recording sheet pack according to claim 6, wherein said protective cover sheet is formed of a plastic resin, and wherein said thin membrane band and said annular thin membrane are formed of a film.

* * * * *